United States Patent [19]

Neubauer

[11] 4,296,354

[45] Oct. 20, 1981

[54] TRAVELING WAVE TUBE WITH FREQUENCY VARIABLE SEVER LENGTH

[75] Inventor: Michael L. Neubauer, Menlo Park, Calif.

[73] Assignee: Varian Associates, Inc., Palo Alto, Calif.

[21] Appl. No.: 98,011

[22] Filed: Nov. 28, 1979

[51] Int. Cl.[3] ..... H01J 25/34

[52] U.S. Cl. ..... 315/3.5; 315/3.6; 315/39.3; 330/43

[58] Field of Search ..... 315/3.5, 3.6, 39.3; 330/43

[56] References Cited

U.S. PATENT DOCUMENTS

| | | | |
|---|---|---|---|
| 3,387,168 | 6/1968 | Beaver | 315/3.5 |
| 3,389,291 | 6/1968 | Ruetz | 315/3.6 |
| 3,397,339 | 8/1968 | Beaver et al. | 315/3.5 X |
| 3,440,555 | 4/1969 | Wolkstein | 330/43 |
| 3,693,038 | 9/1972 | Scott et al. | 315/3.5 |
| 3,903,449 | 9/1975 | Scott et al. | 315/3.6 |
| 3,938,056 | 2/1976 | Pond | 330/43 |
| 3,940,654 | 2/1976 | Winslow | 315/3.5 |
| 4,107,575 | 8/1978 | Vandeplaats et al. | 315/3.6 |
| 4,158,791 | 6/1979 | Lien et al. | 315/3.6 |

*Primary Examiner*—Saxfield Chatmon, Jr.

*Attorney, Agent, or Firm*—Stanley Z. Cole; Peter J. Sgarbossa

[57] ABSTRACT

In a traveling wave tube (TWT) with a non-dispersive interaction circuit such as a helix, the length of the circuit in wavelengths, and hence the gain of the tube, varies with the frequency. The variations of gain over a very wide bandwidth can cause oscillation problems. The invention provides an inverse variation with frequency of the physical length over which the circuit interacts with the beam. This is done by resonant attenuators coupling to the interaction circuit over various lengths depending on their resonant frequency, the attenuation being enough to effectively remove the interaction circuit wave. The attenuators are preferably formed of resonant sections of slow-wave circuit deposited on longitudinal ceramic rods such as the helix support rods.

25 Claims, 4 Drawing Figures

TRAVELING WAVE TUBE WITH FREQUENCY VARIABLE SEVER LENGTH

DESCRIPTION

1. Field of the Invention

The invention pertains to traveling wave tubes (TWT's) which operate over very wide frequency bands of the order of an octave. Such tubes use slow-wave interaction circuits which are helixes or similar circuits derived from the helix which generally do not have lower frequency cut-offs. In such tubes there is normally a very large variation in gain across the operating frequency band, caused in large part by the fact that the number of electrical wavelengths in the fixed physical interaction length of the tube varies approximately proportional to the signal frequency.

2. Prior Art in wide-band TWTs, it has been well known to compensate the variation of gain with frequency by inserting, in the drive signal transmission line to the tube input, an attenuator whose loss is tailored by frequency-sensitive circuits to be the inverse function of the variation of gain. Very many circuits have been devised for these equalizers, using resonant circuits or the frequency-sensitive properties of transmission lines. U.S. Pat. Nos. 3,548,344 issued Dec. 15, 1970 and 3,510,720 issued May 5, 1970, both to J. L. Putz and both assigned to the assignee of the present invention are good examples.

These so-called external equalizers are expensive to manufacture and have the inherent disadvantage that they attenuate the signal before it is amplified by the TWT. The resulting lower input power to the TWT inherently worsens the noise figure of the combined amplifier because the noise figure is mostly determined by the input portion of the TWT.

Another approach to equalization is described in U.S. Pat. No. 3,755,754 issued Aug. 28, 1973 to John L. Putz and assigned to the assignee of the present invention. According to this patent, a portion of the input signal is passed through an auxilliary amplifier having the same distortion characteristics as the main amplifier and is then added back into the TWT input in phase opposition to the orignial signal to compensate for the gain variations. This scheme has the same disadvantages as the input line attentuators described above, in that it reduces the tube's input signal.

It should be pointed out that an equalizer in the output line from the TWT is also bad because at the frequencies having high gain, the TWT output would be over-saturated.

U.S. Pat. No. 4,158,791 issued June 19, 1979 to Erling L. Lien and A. W. Scott and co-assigned with the present application describes lossy attenuators attached to dielectric rods in a helix-type TWT which are resonant at a frequency where oscillations are possible, such as the "backward wave oscillation" frequency where the phase shift is 180° per helix turn. These frequencies are outside the operating band of the TWT, so all that is needed is enough attentuation at these frequencies. Since the attenuated frequencies are not in the operating frequency band, they do not appreciably effect the variation of gain with frequency in that band and the problem of equalization still persists.

SUMMARY OF THE INVENTION

An object of the invention is to provide a gain equalizer for a helix-type TWT incorporated within the tube structure.

A further object is to provide an inexpensive equalizer.

A further object is to provide an equalizer which does not degrade the signal-to-noise ratio.

These objects are achieved by automatically varying the length of the interaction circuit which effectively interacts with the electron beam to produce amplification. The gain, of course, increases directly with this interaction length. The length is varied by introducing an internal attenuation which is effective over a prescribed physical length distant from the input and output ends of the interaction circuit. The attenuators are frequency selective and are extended along the interaction circuit such that the distance over which the signal is attenuated to zero or negative gain is a function of frequency selected to equalize the gain of the tube. The attenuators are preferably resonant sections of slow-wave circuit propagating electromagnetic waves in the direction of propagation of the interaction circuit so that they are electromagnetically coupled to it. They are preferably attached to ceramic rods extending in the direction of wave propagation. The rods may be the supporting rods for the helix-type interaction circuit. The length occupied by the attenuators is preferably remote from both the input and output ends of the interaction circuit, so the noise figure is not degraded and the output efficiency remains high.

DESCRIPTION OF THE PREFERRED EMBODIMENTS

High-gain TWTs generally incorporate, near the center of their interaction circuit, means called a "sever" which removes the electromagnetic wave flowing on the circuit such that the wave energy transmitted through the sever is only the radio frequency component of the electron beam current. Severs are required to prevent oscillations caused by reflections of the wave from imperfectly matched coupling of the interaction circuit to input and output transmission lines. The reflected wave would otherwise be reflected back and forth across the circuit, amplified at each forward pass until oscillations occur.

Two types of sever are common. In one, the interaction circuit is physically divided, the adjoining ends of each portion being coupled to attenuators to absorb the electromagnetic wave. In other cases the attenuator is simply coupled to the interaction circuit and extends over an axial distance sufficient to provide adequate attenuation. In this latter type of sever not only is the circuit wave removed but over the length of the attenuator the gain of the tube is reduced. The electrical discontinuity and the extended attenuator may be combined.

The variable sever length of the present invention is related to the extended attenuator. It may provide the oscillation suppression but its main purpose is quite different, to equalize the frequency varying gain of the TWT.

Attenuation is provided over a length of interaction circuit such that over this length the gain is substantially reduced, preferably to zero or even a negative value. A plurality of attenuators are provided, covering a variety of physical lengths of interaction circuit. Each attenuator is frequency selective, providing attenuation over only a part of the tube's bandwidth. The length of each attenuator is selected as a function of its effective or resonant frequency to suppress the gain over a circuit length sufficient to reduce the total tube gain to the resultant desired value. Generally, an attenuator effective at a higher frequency will be made longer than one effective at a lower frequency. The amplifying length of the unattenuated circuit will thus be shorter at these higher frequencies. Since the number of electrical wavelengths per unit length of interaction circuit is greater at high frequencies, the gain per unit length is higher. The higher gain is compensated by the shorter effective interaction length provided by the invention.

The attenuators are preferably near the center of the interaction circuit. By having them remote from the input end, the noise figure is not degraded as it is with conventional equalizers, because the signal is amplified, establishing the signal-to-noise ratio, before it is attenuated. By having them remote from the output end the output efficiencey is kept high, because a certain minimum unattenuated gain precedes the output.

Figure 1:
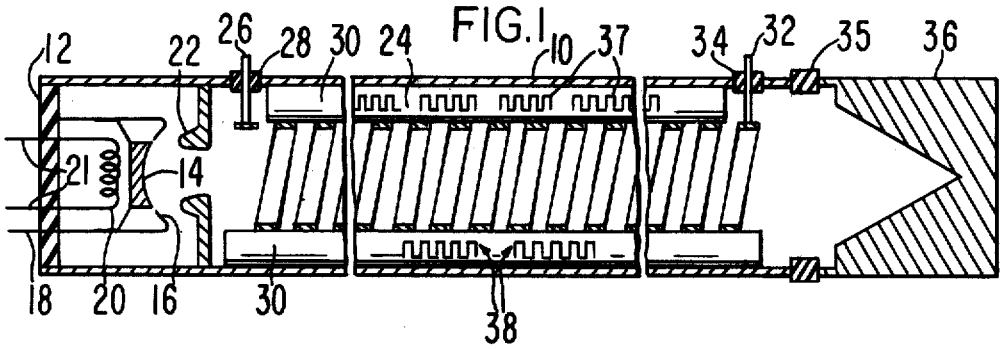
FIG. 1 is a schematic cross-section of a TWT embodying the invention.

FIG. 1 schematically illustrates a simplified embodiment of the invention. This is a section through the axis of a helix TWT. A metallic vacuum envelope 10 is sealed at one end by a ceramic insulator 12 which supports and insulates a concave thermionic cathode 14. Surrounding cathode 14 and at the same potential is a conical focus electrode 16 of the well-known Pierce type. Cathode 14 and focus electrode 16 are connected to a lead-through conductor 18 for applying the negative cathode potential. Behind cathode 14 is a radiant heater 20 supplied with heating current through insulated leads 21. In front of cathode 14 is an annular accelerating electrode 22, also known as the anode. A converging beam of electrons from cathode 14 is focused by an axial magnetic field (not shown) through the hollow center of interaction circuit 24, here shown as a simple helix wound conducting tape. Input signal to helix 24 is introduced over conducting wire 26 passing through envelope 10 via an hermetically sealed ceramic insulator 28. Helix 24 is supported and cooled by a plurality of dielectric rods 30, as of alumina or berylia ceramic, which are closely fit inside envelope 10 to provide thermal contact as well as mechanical support. The output end of helix 24 is connected via conducting wire 32 to the useful rf load. Wire 32 exits through vacuum envelope 10 via insulator 34. Beyond output 32, envelope 10 is sealed via an annular insulator 35 to a metallic collector 36. The electron beam is allowed to expand after leaving helix 24 to be collected on the hollow interior of collector 36 whence the heat generated is removed to an external sink. Two support rods 30 are shown as if the section were made directly in front of them. On the upper rod is an attenuator composed of four resonant elements 37, each element being a half-wavelength of lossy slow-wave circuit attached to rod 30. In this illustration the slow-wave circuit is a convenient meander line propagating in the direction of propagation of interaction circuit 24 and is deposited by a metallizing operation onto the ceramic rod. The attenuator on the lower rod 30 consists of only two half-wave resonant sections 38. They are resonant at a lower frequency than sections 37 on the upper rod and occupy a shorter axial distance. Thus, at the lower frequency a greater length of unattenuated helix is available for signal amplification.

Figure 2:
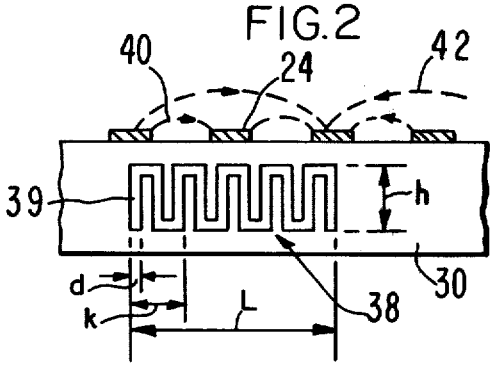
FIG. 2 is an enlarged view of a section of FIG. 1 showing the rf field distribution and the preferred length of attenuator.

FIG. 2 illustrates preferred dimensions of the resonant slow-wave circuit 38 such as would be used for mid-band attenuation. At the center of its operating band, a TWT typically has about 90° of phase shift per turn of the helix. This means that at every second turn the instantaneous rf electric field 42 reverses as illustrated. Hence, for maximum coupling of resonator 38 to helix 24 the overall physical length L of resonator 38 should be equal to twice the pitch of helix 24. The resonant frequency of meander line resonator 38 is determined by its transverse width h and its period k. An approximately TEM wave travels the meandering length of the conductor so that the meandering length should be approximately a half-wavelength of line on a ceramic base. For other frequencies of attenuation the physical length L of the resonant element may be chosen as approximately one-half the wavelength of the axially propagating interaction circuit wave at that frequency.

Figure 3:
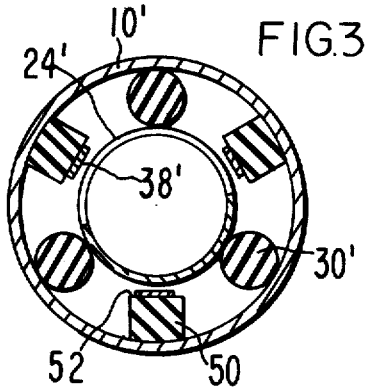
FIG. 3 is a sectional view of a slightly different embodiment of the invention.

In FIG. 3 is shown a slightly different embodiment in which the resonant attenuator elements 38' are supported not on the support rods 30' but on the inner faces 52 of special elongated dielectric rods 50. In this configuration circuits 38' may be closer and thus have greater coupling to interaction circuit 24'.

Figure 4:
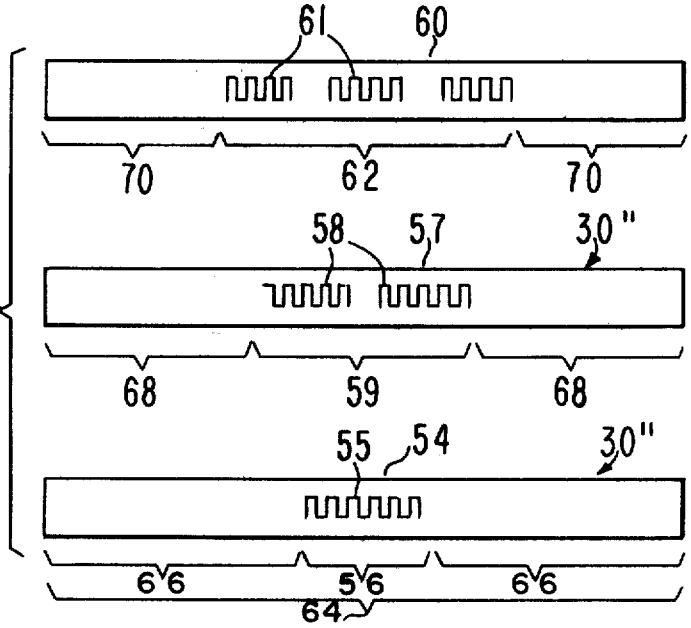
FIG. 4 is a display of three separated attenuator arrays.

FIG. 4 is an illustration showing three separated attenuators such as used in the tube of FIG. 3. Each attenuator is supported on its own dielectric rod 30''. Low frequency attenuator 54 consists of a single resonant element 55 occupying a short axial length 56. Mid-frequency attenuator 57 consists of two resonant elements 58 extending over a greater axial length 59. High frequency attenuator 60 consists of three resonant elements 61 occupying a still greater axial length 62. Of the total lengths of interaction circuit 64, the unattenuated portions 66, 68, 70 over which the gain is produced comprise a progressively shorter axial extent for the progressively higher frequencies at which attenuators 54, 57, 60 are resonant and therefore suppress the gain. Thus, the number of electrical wavelengths on the unattenuated portion of interaction circuit can be made constant or alternatively made any chosen function of frequency to equalize the gain.

It wil be obvious to those skilled in the art that many other embodiments of the invention are possible within its true inventive scope. There are several forms of helix-derived interaction circuit which would be suitable, such as the ring-bar or cross-wound helix, multiple-pitch helixes, etc. The resonant attenuating elements can be of an even wider diversity of types, such as lumped constant printed circuits, or sections of wire helixes attached to the ceramic rods. More than one attenuator assembly can be resonant at a given frequency if higher attenuation is desired. Several attenuator assemblies can be attached to a single dielectric rod. The helix-derived circuit can by physically severed. The variable-sever attenuator may be combined with a non-frequency selective attenuator for oscillation suppression. The scope of the invention is intended to be limited only by the following claims and their legal equivalence.

I claim:

1. A traveling tube having internal gain compensation, comprising:

A helix-type interaction circuit for supporting interaction of an electron beam with microwave signals over an operable band of frequencies, said interaction tending to produce a gain varying with frequency, a first attenuator resonant at a first frequency within said operable band and coupled to said interaction circuit over a first length of said interaction circuit, and a second attenuator resonant at a second frequency within said band and coupled to said interaction circuit over a second length, said first and second frequencies being generally identified with frequencies in said operable band whose gain is sought to be compensated, whereby gain of said frequencies within said operable bandwidth is automatically compensated internally.

2. The tube of claim 1 wherein said attenuators comprise resonant sections of slow-wave circuit adapted to propagate electromagnetic waves in the direction of propagation of said interaction circuit.

3. The tube of claim 1 wherein said attenuators comprise resonant conductive circuits attached to at least one dielectric rod extending in the direction of propagation of said interaction circuit.

4. The tube of claim 3 wherein said conductive circuits are resonant sections of slow-wave circuit adapted to propagate in said direction of propagation of said interaction circuit.

5. The tube of claim 3 wherein said conductive circuits are metallized patterns on the surface of said rod.

6. The tube of claim 1 wherein said first attenuator comprises a plurality of conductive circuits resonant near the same frequency and distributed over said first length.

7. The tube of claim 1 wherein said first frequency is higher than said second frequency and said first length is longer than said second length.

8. The tube of claim 1 wherein said lengths are remote from the input and output ends of said interaction circuit.

9. The tube of claim 1 in which said lengths are extended so that gain for said first and second frequencies is automatically limited to a level comparable to the gain for the remaining band of said tube.

10. The tube of claim 1 in which said lengths are extended to reduce gain for said first and second frequencies at least to zero respectively over said first and second lengths.

11. The tube of claim 1 in which said first and second lengths of said resonant attenuators are a function of said first and second resonant frequencies, respectively.

12. An internally gain-compensated traveling tube comprising:

a helix-type interaction circuit for slow-wave interaction of microwave signals with a linear electron beam over a wide operating band of frequencies, said interaction tending to produce a gain which varies with frequency;

a plurality of resonant means within said tube, each resonant at a different respective frequency, each extending over a respective different length, each adjacent said interaction circuit, for electromagnetically coupling into said interaction circuit a respective frequency-selective loss to internally compensate said frequency-varying gain automatically over said operating band.

13. A traveling wave tube as in claim 12 in which each said respective length is a function of said respective frequency.

14. A traveling wave tube as in claim 12 in which said plurality of means compensates a plurality of respective frequencies to suppress gain about each of said frequencies to at least zero over said lengths of said interaction circuit corresponding to each said means.

15. A traveling wave tube as in claim 12 in which a length associated with a relatively higher frequency is longer than a length associated with a lower frequency.

16. A traveling wave tube as in claim 12 in which each said means includes a resistive conductor shaped to be resonant at said associated frequency.

17. A traveling wave tube as in claim 16 in which each said resistive conductor extends in a direction of propagation of said interaction circuit.

18. A traveling wave tube as in claim 12 in which said interaction circuit has an input end, and said plurality of means is spaced away from said input end so as not to introduce noise.

19. A traveling wave tube as in claim 18 in which said interaction circuit also has an output end, and said plurality of means is also spaced away from said output end to aid output efficiency.

20. A traveling wave tube having noise-resistant internal gain compensation comprising:

a helix-type slow-wave circuit having an input end for microwave signals, said signals interacting with a linear electron beam over a selected band of frequencies, said interaction tending to produce a gain which varies with frequency, a dielectric rod near said circuit extending in the direction of the axis of said slow-wave circuit; and a first resistive conductor shaped to form a circuit resoanant at a first frequency within said tube, said conductor being attached to the surface of said rod so as to extend over a first length of said slow-wave circuit; and a second resistive conductor shaped to form a circuit resident at a second frequency within said band, said conductor being attached to the surface of said rod so as to extend over a second length of said slow-wave circuit;

said conductors both being spaced away from said input end, said conductors providing respective different degrees of attenuation about said first and second frequencies to compensate said gain varying with frequency without degrading the anti-noise properties of said tube.

21. A traveling wave tube as in claim 20, in which, over said first and second lengths, said gain for said first and second frequencies is respectively reduced at least to zero, whereby the length of said interaction circuit for said first and second frequencies is effectively reduced by the distance of said first and second lengths, respectively.

22. A traveling wave tube as in claim 20, in which said first and second lengths are chosen to reduce the gain about said first and second frequencies to a desired value compatible with the overall tube gain over said band.

23. A traveling wave tube as in claim 20 in which each said respective length of said inductors is a function of said resonant frequency associated therewith.

24. A traveling wave tube as in claim 20 in which further ones of said resistive conductors, each extending over a different respective length, are provided to effect attentuation about further frequencies within said band.

25. A traveling wave tube as in claim 20 in which said conductors are also spaced away from the output end of said slow-wave circuit.

* * * * *